United States Patent [19]

Skidmore

[11] 4,230,002

[45] Oct. 28, 1980

[54] FUNNEL EMPLOYING TOOL FOR REMOVING PLUG AND DRAINING OIL FROM VEHICLE OIL PAN

[76] Inventor: Paul E. Skidmore, 2535 N. 68th St., Scottsdale, Ariz. 85257

[21] Appl. No.: 62,970

[22] Filed: Aug. 2, 1979

[51] Int. Cl.[3] ..... B25B 13/06

[52] U.S. Cl. ..... 81/121 R; 7/100

[58] Field of Search ..... 7/100; 81/53 R, 3.1 R, 81/90 D, 121 R, 180 R; 145/50 A

[56] References Cited

U.S. PATENT DOCUMENTS

| | | | |
|---|---|---|---|
| 2,746,330 | 5/1956 | Pfetzing | 81/53 R |
| 3,301,282 | 1/1967 | Fresolone, Jr. | 81/121 R X |
| 3,352,184 | 11/1967 | Panzardi | 81/3.1 R |
| 3,371,563 | 3/1968 | Lallo | 81/90 D |
| 3,379,078 | 4/1968 | Sallows | 81/53 R X |
| 3,635,262 | 1/1972 | Stebbins | 81/53 R X |
| 3,677,513 | 7/1972 | Truelove | 81/121 R X |
| 3,855,882 | 12/1974 | Wittmann | 81/121 R |
| 3,911,983 | 10/1975 | Wyatt | 81/90 D X |
| 4,177,529 | 12/1979 | Sikula, Jr. | 7/100 |

*Primary Examiner*—James G. Smith

*Attorney, Agent, or Firm*—Warren F. B. Lindsley

[57] ABSTRACT

A dual purpose tool for removing drain plugs and draining oil from vehicle oil pans.

9 Claims, 5 Drawing Figures

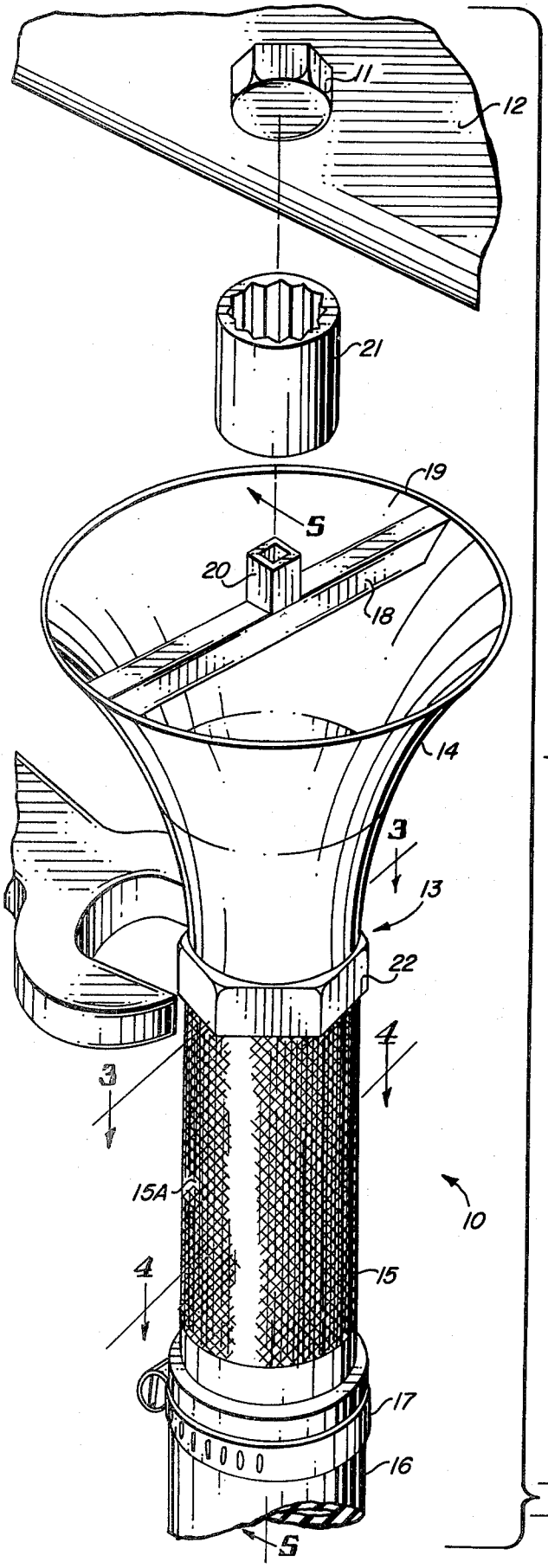
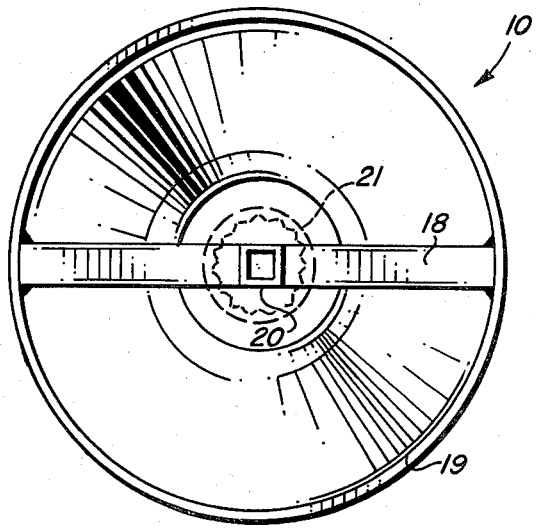
FIG. 2
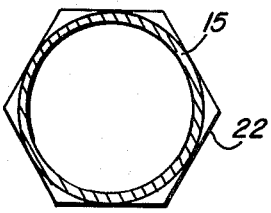
FIG. 3
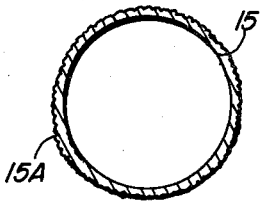
FIG. 4
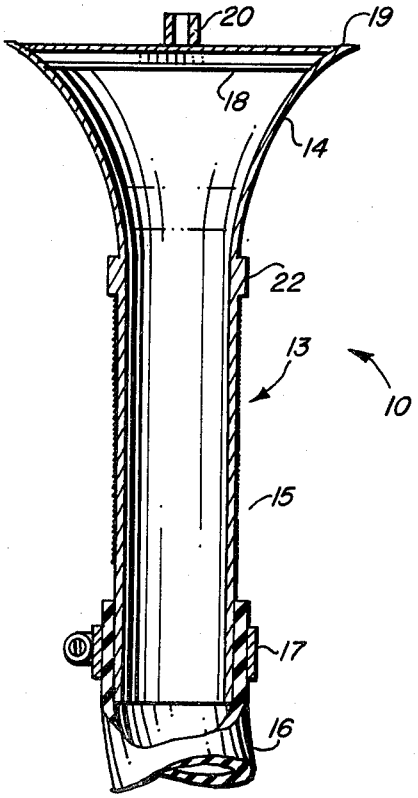
FIG. 1 FIG. 5

FUNNEL EMPLOYING TOOL FOR REMOVING PLUG AND DRAINING OIL FROM VEHICLE OIL PAN

BACKGROUND OF THE INVENTION

Drain plugs in vehicle oil pans are loosened and removed by hand using a suitable wrench and before the oil starts to drain by gravity therefrom, a drain pan or funnel shaped container is quickly positioned below the drain port to catch the oil. Many times, this sequence of operation is not preformed swiftly enough and at least some of the oil drains on the floor or ground before the container is positioned below and aligned with the drain port.

This problem is particularly acute if the oil in the oil pan is being changed when the vehicle is only elevated enough for the service man or woman to horizontally slide under the vehicle. Accordingly, a need exists for a tool which will loosen the drain plug while simultaneously aligning a container such as a funnel below the drain port for catching the draining oil.

FIELD OF THE INVENTION

This invention is directed to tools for servicing vehicles and more particularly to a dual purpose tool for loosening a drain plug in an oil pan and simultaneously aligning a funnel with the drain port for catching and conducting the draining oil to a suitable container.

DESCRIPTION OF THE PRIOR ART

No patents or structures are known which comprise a unitary dual purpose tool for simultaneously removing a drain plug from an oil pan and catching the draining oil.

SUMMARY OF THE INVENTION

In accordance with the invention claimed, an improved dual purpose tool is provided for removing a drain plug in an oil pan of a vehicle and simultaneously catching the draining oil.

It is, therefore, one object of this invention to provide an improved tool for servicing vehicles.

Another object of this invention is to provide an improved dual purpose tool which forms with a socket nut, a socket wrench and an oil collecting funnel.

A further object of this invention is to provide a dual purpose tool for removing a drain plug and catching the draining oil which may be hand or tool rotated.

A still further object of this invention is to provide a dual purpose device for loosening and removing a drain plug from an oil pan and catching the draining oil wherein the tool for mating with a socket nut to form a socket wrench is mounted in the mouth of a funnel.

These and other objects and advantages of the present invnetion will become more apparent as the description proceeds and the features of novelty which characterize this invention will be pointed out with particularlity in the claims annexed hereto and forming a part of this specification.

BRIEF DESCRIPTION OF THE DRAWING

FIG. 1 is an exploded perspective view of a funnel shaped tool employing my invention shown in position with a socket and a drain plug of an oil pan;

FIG. 2 is a top view of FIG. 1;

FIG. 3 is a cross-sectional view of FIG. 1 taken along the line 3—3;

FIG. 4 is a cross-sectional view of FIG. 1 taken along the line 4—4; and FIG. 5 is a cross-sectional view of FIG. 1 taken along the line 5—5.

DESCRIPTION OF THE PREFERRED EMBODIMENT

Referring more particularly to the drawing by characters of reference, FIGS. 1–5 disclose a dual purpose tool 10 for removing the drain plug 11 from an oil pan 12 of a vehicle.

The tool 10 comprises a funnel 13 having a flared end 14 forming the mouth thereof for receiving the oil draining from the oil pan 12, an elongated stem, neck or tubular portion 15, one end of which is integral with the flared end 14 and the other end of which is connectable to suitable drain hose 16. End 14 may be slidably connected to one end of hose 16 and held thereon by a friction fit or slidably fitted over the free end of the tubular portion 15 of funnel 13 and held thereon by a clamp, such as hose clamp 17.

The outer surface of the tubular portion 15 of the funnel 13 may be roughened or provided with a knurled surface 15A so as to be more readily gripped by the hand of the user for rotation thereof.

As shown in FIGS. 1, 2, and 5 of the drawing, a brace or bracket 18 is mounted to extend across the circular opening of the flared end 14 of funnel 13 along its diameter. The top surface of this bracket is shown flush with the periphery 19 of the flared opening of the funnel but it may lie within the flared opening and still fall within the scope of this invention. Mounted on the exposed top surface of this bracket and coaxially aligned with the axis of funnel 13 is mounted a square or rectangular eye or head member 20 for snugly receiving thereover a socket 21. Socket 21 is the usual socket tool used for snugly surrounding the drain plug 11 for gripping and rotating it for removal of it from the oil pan in the usual manner.

In many instances, enough torque may be applied to the drain plug 11 by the user gripping the knurled surface 15A of the tubular portion 15 of the tool and rotating it counterclockwise as shown in FIG. 1. However, if this is not possible, the tool may be provided with a collar 22 formed in the shape of a hexagon nut which is integral with portion 15 of the tool. As shown, collar 22 is arranged below the flared portion of the funnel 13, although it may be positioned any place along the tubular portion 15 of the tool and still lie within the scope of this invention. Thus, by gripping collar 22 with an open ended wrench 23, as shown in FIG. 1, the tool may be easily rotated to remove the drain plug from the oil pan.

Thus, it is evident that the drain plug 11 can be removed easily by the disclosed funnel shaped tool and held in place in the socket 21 positioned over head 20 simultaneously with the draining of oil through the drain port of the oil pan through the funnel 13 and hose 16 clamped thereto to a suitable container (not shown). Since the flared end 14 of funnel 13 is closely adjacent the oil pan 12 and surrounding the drain plug 11, no oil escapes the funnel as it drains out of the oil pan. It should be noted that the same tool may be used to replace the drain plug.

It will be apparent to those skilled in the art that changes and other modifications may be made to the tool shown and described herein without departing from the spirit of the invention or from the scope of the appended claims.

What is claimed is:

1. A dual purpose tool for removing drain plugs of vehicle oil pans and substantially simultaneously receiving the oil draining therefrom comprising:

a funnel shaped member, said member having an open flared end for receiving the oil draining from the drain port of the vehicle oil pan and a tubular portion integral with the neck of said member and extending therefrom, the free end of said tubular portion arranged for receiving a drain hose in a snug fit therewith, a bracket extending across the flared end of said member, and a head mounted on said bracket and extending outwardly of said member for receiving a socket in a snug interlocking fit therewith, whereby the tool mounted socket when pushed over a drain plug and the tool rotated, the socket will loosen and remove the drain plug from the oil pan and said member will receive the oil released by said drain plug.

2. The dual purpose tool set forth in claim 1 wherein:

the outer surface of said bracket is substantially flush with the periphery of said flared end.

3. The dual purpose tool set forth in claim 1 wherein: said head is axially aligned with the longitudinal axis of the tool.

4. The dual purpose tool set forth in claim 1 wherein: said flared end of said member, said head and said tubular portion are all axially aligned.

5. The dual purpose tool set forth in claim 1 wherein: the outer surface of said tubular portion is provided with a knurled surface.

6. The dual purpose tool set forth in claim 1 wherein: said tubular portion is provided with a collar around its outer periphery for gripping by an open ended wrench for rotating the tool.

7. The dual purpose tool set forth in claim 6 wherein: the outer periphery of said collar is of a hexagonal configuration.

8. The dual purpose tool set forth in claim 6 wherein: said collar is positioned on said tubular portion adjacent said flared end of the tool.

9. The dual purpose tool set forth in claim 1 wherein: said head has a square cross-sectional configuration.

* * * * *